US007236137B2

(12) United States Patent
Yoshino et al.

(10) Patent No.: US 7,236,137 B2
(45) Date of Patent: Jun. 26, 2007

(54) EARPHONE ANTENNA, COMPOSITE COIL AND COAXIAL CABLE USED THEREFOR, AND WIRELESS DEVICE PROVIDED WITH THE EARPHONE ANTENNA

(75) Inventors: Yoshitaka Yoshino, Tokyo (JP); Minoru Oozeki, Kanagawa (JP); Toshiyuki Imagawa, Saitama (JP)

(73) Assignee: Sony Corporation (JP)

( * ) Notice: Subject to any disclaimer, the term of this patent is extended or adjusted under 35 U.S.C. 154(b) by 25 days.

(21) Appl. No.: 10/546,449

(22) PCT Filed: Feb. 12, 2004

(86) PCT No.: PCT/JP2004/001485

§ 371 (c)(1),
(2), (4) Date: Aug. 19, 2005

(87) PCT Pub. No.: WO2004/077606

PCT Pub. Date: Sep. 10, 2004

(65) Prior Publication Data

US 2006/0071869 A1 Apr. 6, 2006

(30) Foreign Application Priority Data

Feb. 28, 2003 (JP) ..... 2003-052874

(51) Int. Cl.
*H01Q 1/12* (2006.01)

(52) U.S. Cl. ..... 343/718; 343/702; 455/569.1; 455/575.1

(58) Field of Classification Search ..... 343/702, 343/718; 455/569.1, 575.1
See application file for complete search history.

(56) References Cited

U.S. PATENT DOCUMENTS

| | | | | |
|---|---|---|---|---|
| 4,044,303 | A * | 8/1977 | Reindel | 324/95 |
| 5,945,963 | A * | 8/1999 | Leisten | 343/895 |
| 2005/0245289 | A1 * | 11/2005 | Yoshino | 455/569.1 |

FOREIGN PATENT DOCUMENTS

| | | |
|---|---|---|
| JP | 59-108348 | 7/1984 |
| JP | 06-022331 | 1/1994 |
| JP | 06-088015 | 3/1994 |
| JP | 10-056325 | 2/1998 |
| JP | 10-084209 | 3/1998 |
| JP | 11-317309 | 11/1999 |

OTHER PUBLICATIONS

International Search Report mailed Aug. 17, 2004.

* cited by examiner

*Primary Examiner*—Tho Phan
(74) *Attorney, Agent, or Firm*—Rader Fishman & Grauer PLLC; Ronald P. Kananen

(57) ABSTRACT

An earphone antenna in which a balun is connected to one side and the other side having an audio/high-frequency dual-function signal connecting the earphone unit via a loading coil and wireless equipment connected to the balun, the loading coil selecting low impedance for fundamental frequency and selecting to obtain high impedance for higher frequencies, in order to integrate earphone and antenna.

21 Claims, 6 Drawing Sheets

EARPHONE ANTENNA, COMPOSITE COIL AND COAXIAL CABLE USED THEREFOR, AND WIRELESS DEVICE PROVIDED WITH THE EARPHONE ANTENNA

This application is a 371 of PCT/JP04/01485, filed Feb. 12, 2004.

TECHNICAL FIELD

The present invention relates to a so-called earphone antenna in which earphones are connected to wireless equipment for reproducing audio (emitting sound) and cords of which are used as an antenna. Particularly, the invention relates to an earphone antenna, a composite coil and a coaxial cable used for the earphone antenna, and a wireless device provided with the earphone antenna, which are capable of obtaining a high receiving sensitivity over a wide range of frequencies without performing a sensitivity adjusting operation or a receiving frequency switching operation, and which are not subject to a negative influence from the human body through the earphones.

BACKGROUND ART

As an antenna for a wireless device that receives high-frequency electrical waves, one using earphones themselves, one formed by arranging conductor lines within a housing of the wireless device, and the like have typically been used. It has been difficult to obtain a sufficient receiving sensitivity with these antennas. Thus, a loop antenna introduced in Japanese Patent Application Publication No. 10-84209 has been developed. Antennas of this type have a configuration in which a loop antenna is attached to a neck strap of a small-sized wireless device, and in which an inductance element is connected in parallel to the loop antenna in such an orientation that a plane of its aperture faces perpendicularly to the surface of the human body.

However, giving no consideration to earphones, and these antennas have addressed an issue that signal lines to the earphones must be provided separately. Thus, an earphone antenna, disclosed in Japanese Patent Application Publication No. 6-22331, has been developed, for example, in which signal lines to earphones are assembled with an antenna for integration into a helmet.

The antenna of the type introduced by, e.g., Japanese Patent Application Publication No. 10-84209 mentioned above and the like, has addressed the issue, first of all, that no consideration is given to the integration of earphones thereinto.

Further, the earphone antenna in which audio signal lines to earphones are integrated with an antenna has addressed the issue that the human body exerts serious influence upon a wireless device through the antenna due to the earphones directly touching the human body and the stability of reception is greatly compromised. Furthermore, the fact that a matching section of the antenna and an equipment section, such as a tuner, are placed within the same equipment has imposed another problem that the earphone antenna is susceptible to noises of the equipment.

While this problem occurs also on radios, this trend is observed more notably on, e.g., portable liquid-crystal TVs (television receivers) that receive television broadcasting waves having receiving frequencies higher than their broadcasting waves. However, the fact is that no effective measures have been taken for that problem.

Furthermore, where a television broadcast is to be received, there has been still another problem that, for a wide band of television broadcasting frequencies, it is difficult to ensure a sufficient receiving sensitivity over the entire wide band.

That is, so-called portable liquid-crystal TVs (television receivers) need to receive high-frequency signals over a very wide band of 90 to 770 MHz. Specifically, in a case of a high-frequency band usable for television broadcasting in Japan, usable frequencies include 90-108 MHz (1-3 channels), 170-220 MHz (4-12 channels) in the VHF band, and 470-770 MHz (13-62 channels) in the UHF band.

It is difficult to obtain a sufficiently high receiving sensitivity over such a wide frequency band, and thus it has been unavoidable that a low receiving sensitivity is exhibited over a certain frequency band. The reason is that it is the loop length of the loop antenna that defines a receiving frequency band, and the receiving sensitivity of the loop antenna decreases for frequencies outside that frequency band.

For this reason, attempts have also been made to develop a sensitivity adjusting means. For example, a sensitivity adjusting component into which a magnetic substance is movably inserted is provided to adjust the amount of insertion of the magnetic substance in accordance with a frequency for reception. However, according to such a sensitivity adjusting means, there has been an inconvenience that sensitivity adjustment must be made every time the frequency for reception is switched.

Note that, as to digital terrestrial broadcasting planned to be introduced in the future, which uses only the UHF frequencies as its broadcasting electrical waves, in a case of a receiver ready for the digital terrestrial waves, it can be said that the receiving frequency band is narrower than in a case of a receiver ready for analog terrestrial waves. However, the conventional earphone antennas are not suitable for receivers ready for digital terrestrial broadcasting. The reason is that, as mentioned above, no effective measures have been taken in order to eliminate high frequency-derived negative influence exerted upon the receivers from the human body via the earphones and the earphone antenna.

The present invention has been made in order to overcome such problems, and an object thereof is to provide an earphone antenna which can eliminate high frequency-derived negative influence exerted upon a receiver side from the human body via earphones, and further, which can remove the influence of noises of the equipment by isolating an antenna section from the receiving equipment, ensure a receiving sensitivity required for a wide band of frequencies without involving a sensitivity adjusting operation, and also transmit audio signals of a television receiver to earphone units, a composite coil and a coaxial cable used therefore, and a wireless device provided with the earphone antenna.

DISCLOSURE OF THE INVENTION

An earphone antenna as claimed in claim 1 has a balun for converting a balanced mode into an unbalanced mode, and it has a pair of audio/high-frequency dual-function signal lines for connection to a left earphone unit and a pair of audio/high-frequency dual-function signal lines for connection to a right earphone unit, connected to terminals on a balanced-mode side of the above-mentioned balun. The earphone antenna is characterized by being configured such that the above-mentioned two pairs of audio/high-frequency dual-function signal lines function as a receiving antenna for high-frequency signals and the above-mentioned two pairs of audio/high-frequency dual-function signal lines function as audio signal transmission means to the above-mentioned left and right earphone units for audio signals.

Therefore, according to the earphone antenna as claimed in claim 1, the above-mentioned balun performs impedance conversion from the balanced mode into the unbalanced mode, and further, the above-mentioned two pairs of audio/high-frequency dual-function signal lines are caused to function as a receiving antenna for high-frequency signals and as audio signal transmission means for audio signals. As a result, integration of the high-frequency receiving antenna with the earphones can be implemented.

A wireless device as claimed in claim 3 is characterized by including the above-mentioned earphone antenna as claimed in claim 1 and a receiving apparatus connected to a terminal on an unbalanced side of the above-mentioned balun of the above-mentioned earphone antenna via a cable.

Therefore, according to the wireless device as claimed in claim 3, since the earphone antenna as claimed in claim 1 is used, the advantages provided by the earphone antenna can be enjoyed.

An earphone antenna as claimed in claim 4 is characterized by having a balun for converting a balanced mode into an unbalanced mode, having a pair of audio/high-frequency dual-function signal lines corresponding to the above-mentioned left earphone unit, and a pair of audio/high-frequency dual-function signal lines corresponding to a right earphone unit, connected to terminals on a balanced-mode side of the above-mentioned balun, and having terminals on a non-balun side of each of the above-mentioned pairs of audio/high-frequency dual-function signal lines connected to a corresponding one of the above-mentioned earphone units via respective loading coils.

The above-mentioned respective loading coils are configured to have a high impedance for signals having a specific frequency (e.g., 200 MHz) having a frequency higher than a pre-set fundamental frequency (e.g., 100 MHz) for isolation from the above-mentioned two pairs of audio/high-frequency dual-function signal lines in terms of high frequency to cause the above-mentioned signal lines to function as a dipole antenna, and they have a low impedance for signals having the above-mentioned fundamental frequency (e.g., 100 MHz) to combine the above-mentioned respective loading coils with the above-mentioned two pairs of audio/high-frequency dual-function signal lines in terms of high frequency by connection so as to function as a dipole antenna formed from both. The above-mentioned respective pairs of audio/high-frequency dual-function signal lines are configured to function as audio signal transmission means for audio signals to the above-mentioned left and right earphone units.

Therefore, according to the earphone antenna as claimed in claim 4, a high-frequency signal can be mode-converted from the balanced mode into the unbalanced mode at the above-mentioned balun, and also the loading coils have a high impedance for signals having a specific frequency (e.g., 200 MHz) higher than a fundamental frequency (e.g., 100 MHz) for isolation from the above-mentioned two pairs of audio/high-frequency dual-function signal lines, whereby to cause the above-mentioned two pairs of audio/high-frequency dual-function signal lines to function as a dipole antenna for resonance.

Further, the above-mentioned loading coils have a low impedance for a signal having the fundamental frequency (e.g., 100 MHz) to cause the above-mentioned two pairs of audio/high-frequency dual-function signal lines and the respective loading connected thereto to function as a dipole antenna for resonance.

Hence, a dipole antenna that resonates at the fundamental frequency (e.g., 100 MHz) and further resonates with its harmonics (a third harmonic at, e.g., 300 MHz, a fifth harmonic at, e.g., 500 MHz, and a seventh harmonic at, e.g., 700 MHz) and a dipole antenna that resonates with signals having a specific frequency (e.g., 200 MHz) higher than a pre-set frequency (e.g., 100 MHz) and that excites with its harmonics (a third harmonic at, e.g., 600 MHz, and the like) are formed from the above-mentioned two pairs of audio/high-frequency dual-function signal lines. As a result, a sensitivity characteristic that exhibits relatively small variations in receiving sensitivity can be obtained over a wide frequency band, and thus no sensitivity adjustment of the earphone antenna is required at all in order to obtain the sensitivity characteristic.

Note that the loading coils shorten an antenna length required for resonance at the fundamental frequency (e.g., 100 MHz), to allow resonance to occur with signals having long wavelengths even with a short antenna length. As a result, the receiving sensitivity to low-frequency signals can be enhanced without unreasonably increasing the antenna length. This is an advantage that is not negligible.

Therefore, a sensitivity characteristic that exhibits relatively small variations in receiving sensitivity can be obtained over a wide frequency band, and thus no sensitivity adjustment of the earphone antenna is required at all in order to obtain the sensitivity characteristic.

Further, according to the earphone antenna as claimed in claim 4, the above-mentioned respective pairs of audio/high-frequency dual-function signal lines and the above-mentioned loading coils are configured to function as audio signal transmission means for audio signals of the above-mentioned left and right earphone units. As a result, integration of the earphone units with the antenna can be implemented.

Therefore, the antenna can be used for reception of high-frequency signals over a wide frequency band, and also it can as means for transmitting audio signals to the earphone units, whereby integration of the high-sensitivity, wide-band antenna with the earphone units becomes possible.

A composite coil as claimed in claim 11 is characterized by winding a plurality of conductor lines around a single core to form a plurality of coils, with each of the above-mentioned coils having the same number of turns and the same impedance.

Therefore, according to the composite coil as claimed in claim 11, a plurality of coils can be formed in a size substantially equal to that of a single coil, whereby it contributes to a downsizing and weight reduction of devices using a plurality of coils. Particularly, if the above-mentioned respective coils constituting each of the above-mentioned composite coils are to be used as the respective loading coils in each of the above-mentioned left and right pairs of loading coils of the earphone antenna, they contribute to a downsizing and weight reduction of the earphone antenna, and thus inconvenience at the time of use of the earphone antenna can be reduced.

A wireless device as claimed in claim 14 is characterized by including the above-mentioned earphone antenna as claimed in claim 4, 5, 6, 7, 9, 10, 12 or 13 and a receiving apparatus connected to a terminal on an unbalanced-mode side of the above-mentioned balun.

Therefore, according to the wireless device as claimed in claim 14, the advantages obtained by the above-mentioned earphone antenna as claimed in claim 4, 5, 6, 7, 9, 10, 12 or 13 can be enjoyed.

A coaxial cable as claimed in claim 15 is characterized by having a central conductor for passing high-frequency signals therethrough, a first insulator for enclosing the above-mentioned central conductor, a shielding wire for enclosing the above-mentioned first insulator, a second insulator for enclosing the above-mentioned shielding wire, and a pair of audio signal lines, wound around an outer side of the above-mentioned second insulator, for transmitting left and right audio signals therethrough. Note that it may be acceptable to configure such that the left and right audio signals are transmitted through a pair of audio signal lines and the above-mentioned shielding wire, but it may otherwise be acceptable to configure such that a common audio signal line is wound around the outer side of the second insulator in addition to the above-mentioned pair of audio signal lines for transmission of the left and right audio signals through these three common audio signal lines.

Therefore, according to the coaxial cable as claimed in claim 15, high-frequency signals (e.g., 100 MHz to 700 MHz) can be transmitted through the above-mentioned central conductor and the above-mentioned shielding wire, and left and right audio signals (e.g., several tens to 20,000 Hz) can be transmitted through the common audio signal lines and the pair of left and right audio signals, whereby a single coaxial cable can be used for transmission of both the high-frequency signals and the left and right audio signals.

Particularly, the coaxial cable can be used in both the high-frequency signals and the left and right audio signals, and thus it is most suitable as a connection means for a wireless device in which each of the above-mentioned various earphone antennas is connected to the receiving apparatus.

BRIEF DESCRIPTION OF DRAWINGS

FIGS. 1A and 1B show a first embodiment of an earphone antenna of the present invention, in which FIG. 1A is a principle-illustrating configurational diagram, and FIG. 1B is an equivalent circuit diagram.

FIGS. 2A-2C show individual components for use in the earphone antenna, in which FIG. 2A is a diagram showing a pin-jack connector, FIG. 2B is a configurational diagram of a coaxial cable, and FIG. 2C is a configurational diagram of a composite coil.

FIGS. 5A and 5B show a second embodiment of an earphone antenna of the present invention, in which FIG. 5A is a configurational diagram, and FIG. 5B is a circuit diagram.

FIGS. 6A and 6B show a third embodiment of an earphone antenna of the present invention, in which FIG. 6A is a configurational diagram, and FIG. 6B is a circuit diagram.

BEST MODES FOR CARRYING OUT THE INVENTION

Figure 1B:
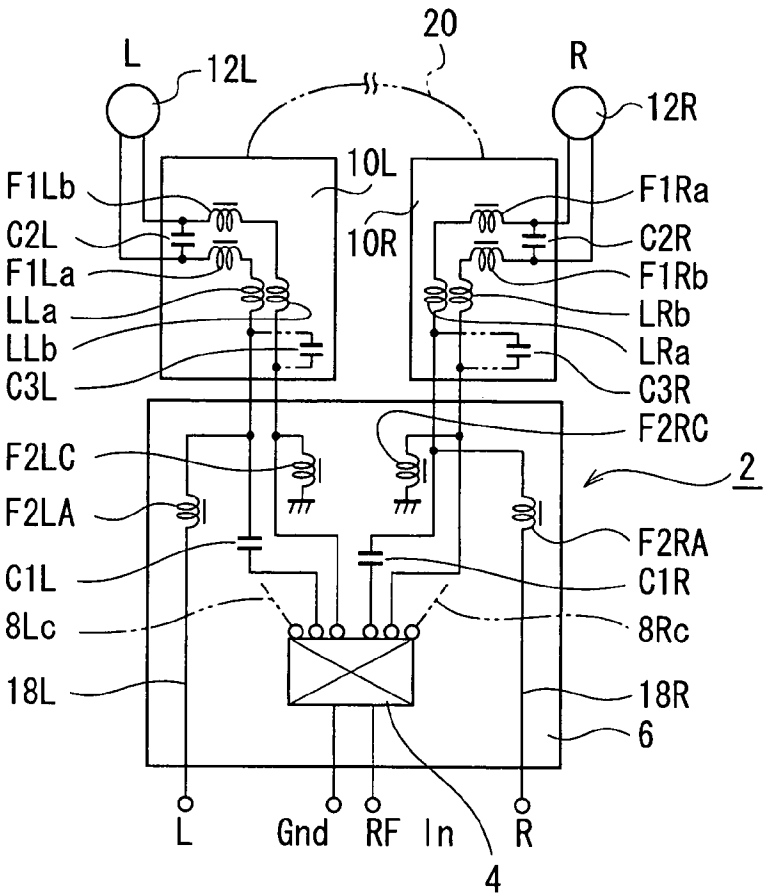

An earphone antenna of the present invention basically includes a balun, and two pairs of audio/high-frequency dual-function signal lines corresponding to left and right earphones connected to terminals on a balanced-mode side of the balun. The two pairs of audio/high-frequency dual-function signal lines are configured to function, for high-frequency signals, as a receiving antenna, and, for audio signals, as audio signal transmission means to the left and right earphone units.

And, for example, in a case of use in a receiver ready for digital terrestrial waves, it may be preferred to use two pairs of audio/high-frequency dual-function signal lines configured as follows. The two pairs of signal lines, each pair having two 15 cm-long and 11 cm-long lines that are 5 or more millimeters spaced apart from each other, are secured symmetrically to form an opening angle of 90° for connection to the balun. The reason for this is that this allows a dipole antenna to be formed which can receive high-frequency signals in the entire UHF band covered by digital terrestrial broadcasting, even with no trouble in transmitting audio signals.

In that case, it may be preferred to interpose high-frequency cutting means (e.g., inductance elements (coils)) between terminals on a non-balun side of the dipole antenna and the earphones. The high-frequency cutting means present high impedance for high-frequency signals (e.g., UHF waves) to cut the high-frequency signals, and present a low impedance for audio signals to permit transmission of the audio signals. The reason is that an influence exerted upon a receiving apparatus side of a wireless device from the human body through the earphones can be thereby eliminated, to enhance the stability of reception.

Further, in a case of use in a receiver ready for ordinary television terrestrial (analog terrestrial) broadcasting, an earphone antenna is used which includes a balun and a pair of loading coils added to each of two left and right pairs of audio/high-frequency dual-function signal lines for connection to left and right earphones. In this case, the loading coils present a high impedance or a low impedance in accordance with different frequency bands, whereby the above-mentioned two pairs of audio/high-frequency dual-function signal lines function as a dipole antenna resonating with high-frequency signals having the above-mentioned specific frequency (200 MHz), and the earphone antenna formed by adding the above-mentioned pair of loading coils to each of the above-mentioned two pairs of audio/high-frequency dual-function signal lines functions also as a dipole antenna resonating at the above-mentioned fundamental frequency (100 MHz).

And, in the case of such use in a receiver ready for ordinary television terrestrial broadcasting, it may also be preferred that only one of audio/high-frequency dual-function signal lines in each of the two pairs of audio/high-frequency dual-function signal lines for connection to the above-mentioned left and right earphone units is connected to a terminal on the balanced side of the balun as to both of the two pairs, and the other of the above-mentioned audio/high-frequency dual-function signal lines in one of the two pairs is connected to the other of the above-mentioned audio/high-frequency dual-function signal lines in the other of the two pairs in terms of high frequency, whereby a folded dipole antenna may be configured which includes one and the other of one pair of the two pairs of dual-function high-frequency signal lines corresponding to the left earphone unit, and one and the other pair of the other of the two pairs of dual-function high-frequency signal lines corresponding to the right earphone unit. In this case, the impedance by the antenna becomes four times, thereby permitting easy impedance matching at the balun.

And, it is preferable to provide high-frequency cutting means, e.g., ferrite beads (or choke coils), between the respective pairs of audio/high-frequency dual-function signal lines in the loading coils and the above-mentioned earphones to prevent the human body exerting a negative influence on the reception of high-frequency signals. The reason is that this can enhance the stability of reception.

Further, it may also be preferred to insert band-expanding capacitors between the above-mentioned audio/high-frequency dual-function signal lines paired for the left and right sides, respectively. The reason is that this can expand the receiving frequency band.

And, it may be preferred to insert high-frequency cutting means, e.g., ferrite beads (choke coils) that present a high impedance for high-frequency signals, along audio signal transmission lines for transmitting audio signals in the respective pairs of audio/high-frequency dual-function signal lines of the above-mentioned dipole antenna, whereby entrance of unnecessary high-frequency signals into the audio signal lines can be prevented.

The loading coils, one pair being provided for each of the left and right sides, may be formed from separate and independent components, respectively. However, such a configuration increases the area occupied by the loading coils and hence of the loading coils having them, which would then potentially increase the size and weight of the earphone antenna. Thus, in order to avoid the potential increase in size and the like, it may be preferred to form each of the pairs of loading coils from a composite coil in which a plurality of coils sharing a single core and having two windings is combined into one piece.

Further, the earphone antenna of the present invention transmits high-frequency signals to a receiving apparatus of a wireless device that is remotely located, and receives audio signals from the receiving apparatus. Thus, it is preferable to use a coaxial cable for transmission/reception of the high-frequency signals, the audio signals to/from the receiving apparatus from the viewpoint of preventing entrance of noise, enhancing stability of reception, and the like. And, as the coaxial cable, it may be preferable to use one provided with a central conductor that passes high-frequency signals therethrough, an insulator enclosing the central conductor, a shielding wire enclosing the above-mentioned insulator, an insulator for enclosing the above-mentioned shielding wire, and left and right audio signal lines on the outer side of the above-mentioned insulator.

The reason is that a single coaxial cable can be used for transmission of both the high-frequency signals and the left and right audio signals, and thus it is most suitable as a coaxial cable for connection to the receiving apparatus of a wireless device. Note that although it may be configurable to transmit left and right sounds using a pair of audio signal lines and the above-mentioned shielding line, it may otherwise be configurable such that, besides the above-mentioned pair of audio signal lines, a common audio signal line is wound around the outer side of the second insulator to transmit the left and right audio signals through these three common audio signal lines.

Each of the above-mentioned signal lines may preferably be made by stranding a plurality of wires so as to impart thereto conductivity, mechanical flexibility, and the like. As its material, for example, annealed copper is suitable.

It may be acceptable to configure the above-mentioned two pairs of audio/high-frequency dual-function signal lines such that portions thereof which are on a side connected to the above-mentioned balun form an angle of approximately 180°. In such a case, the two pairs of audio/high-frequency dual-function signal lines function as a U-shaped dipole antenna for signals having the above-mentioned specific frequency (e.g., 200 MHz).

Further, it may also be acceptable to set the angle to a value smaller than approximately 180°. In such a case, the two pairs of audio/high-frequency dual-function signal lines function as a V-shaped dipole antenna for signals having the above-mentioned specific frequency (e.g., 200 MHz).

In this way, the present invention can be embodied in various modes.

EMBODIMENTS

The present invention will be described below in detail with reference to the embodiments shown in the drawings.

Figure 1A:
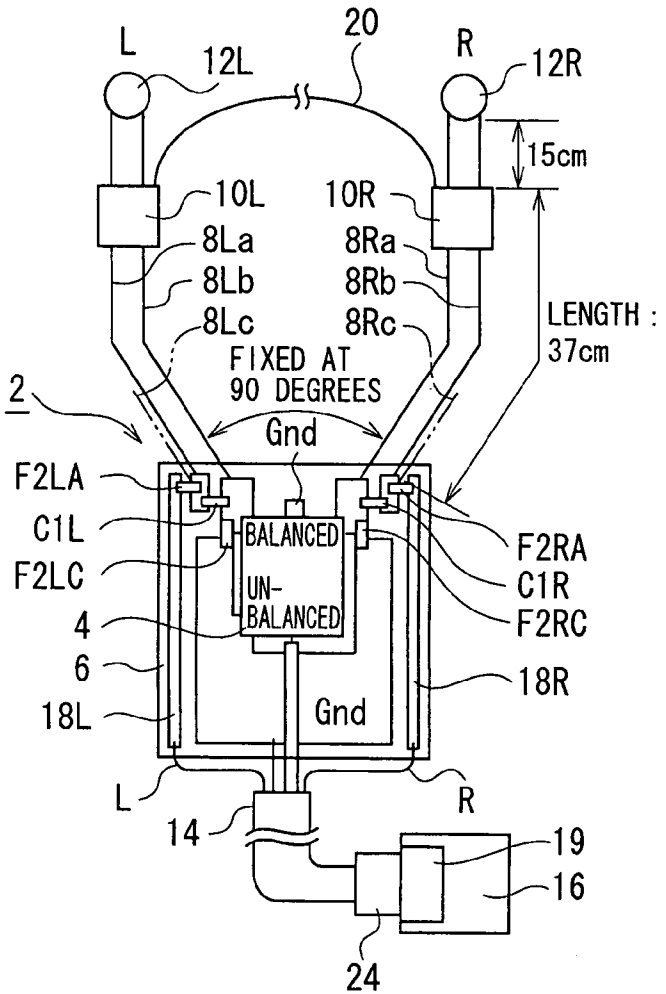
Figure 2A:
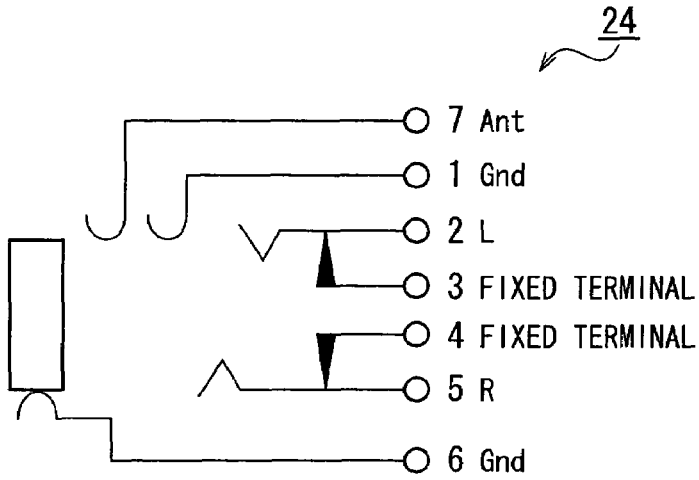
Figure 2B:
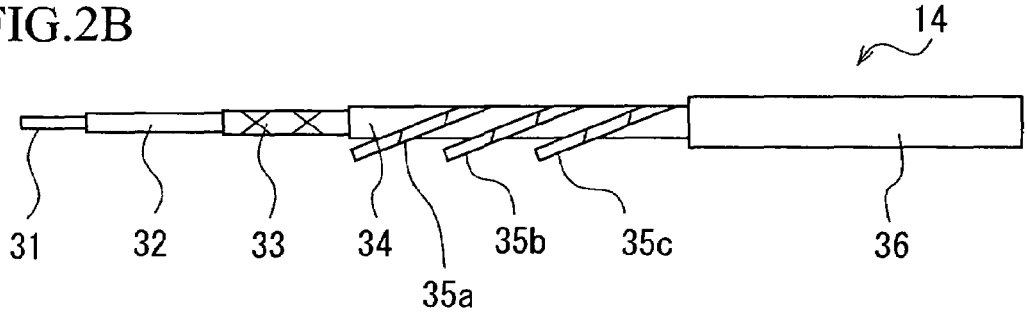
Figure 2C:
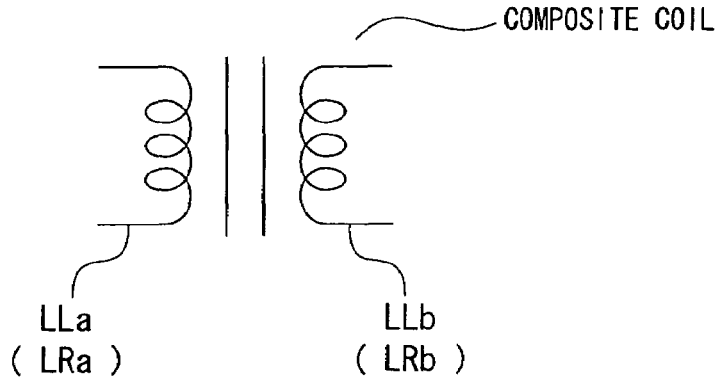

FIGS. 1A and 1B show a first embodiment of an earphone antenna of the present invention, in which FIG. 1A is a principle-illustrating configurational diagram, and FIG. 1B is an equivalent circuit diagram. FIGS. 2A to 2C show individual components for use in the earphone antenna, in which FIG. 2A is a diagram showing a pin-jack connector; FIG. 2B is a configurational diagram of a coaxial cable; and FIG. 2C is a configurational diagram of a composite coil.

In the drawings, reference symbol 2 denotes the present earphone antennal (the first embodiment of the earphone antenna of the present invention), which includes a matching box 6 for housing a balun 4 and the like, audio/high-frequency dual-function signal lines 8La, 8Lb, 8Ra, 8Rb as earphone cords connected to terminals on a balanced side of the above-mentioned balun 4, and a pair of loading boxes 10L, 10R connected to terminals on a non-balun side of the above-mentioned audio/high-frequency dual-function signal lines 8La, 8Lb, 8Ra, 8Rb.

To terminals of the above-mentioned loading boxes 10L, 10R which are opposite to the audio/high-frequency dual-function signal lines 8La, 8Lb, 8Ra, 8Rb, there are connected earphone units 12R, 12L. And, each of the above-mentioned audio/high-frequency dual-function signal lines 8La, 8Lb, 8Ra, 8Rb is formed by stranding a plurality of wires having conductivity, mechanical flexibility, and the like; they are made from, e.g., annealed copper. Further, as stranded wires, insulated litz wires may be used otherwise.

The above-mentioned balun 4 converts a balanced mode into an unbalanced mode, and performs impedance conversion. From one side of the balanced-side terminal, the left-side audio/high-frequency dual-function signal lines 8La, 8Lb extend, and from the other side, the right-side audio/high-frequency dual-function signal lines 8Ra, 8Rb extend at a fixed angle of 30° or more (90° in the present example), for a connection such that they can function as a V-shaped dipole antenna (a portion forming this V-shaped dipole is machined so as to maintain a comparatively high rigidity). Their length from the balun 4 to the impedance boxes 10L, 10R is set to, e.g., 37 cm or more.

The reason for forming one side from two signal lines (8La, 8Lb on the left side and 8Ra, 8Rb on the right side) in this way is to cause these audio/high-frequency dual-function signal lines 8La, 8Lb, 8Ra, 8Rb to function not only as a receiving antenna for high-frequency signals, but also to function as audio signal transmission means that transmits audio signals to the respective left and right earphone units 12L, 12R. Note that in order to expand the frequency band as a receiving antenna (dipole antenna) toward the lower side, it may be acceptable to connect capacitors C3L, C3R between the audio/high-frequency dual-function signal lines 8La, 8Lb and between the audio/high-frequency dual-function signal lines 8Ra, 8Rb, respectively.

Note that as shown by two-dot chain lines in FIGS. 1A, 1B, it may also be acceptable to provide auxiliary antennas 8Lc, 8Rc to supplement the characteristics. It is preferable to set the length of each of the above-mentioned auxiliary antennas 8Lc, 8Rc to, e.g., 50 mm, and provide them at least 5 mm spaced apart from corresponding ones of the audio/high-frequency dual-function signal lines 8La, 8Lb, 8Ra, 8Rb, respectively.

The signal lines 8La, 8Lb, 8Ra, 8Rb (and 8Lc, 8Rc) having such a size and shape as shown in FIG. 1A have a function as a V-shaped dipole antenna in which resonance occurs at a 200-MHz high-frequency signal, and excites with its harmonics (a third harmonic, a fifth harmonic, a seventh harmonic).

Terminals on an unbalanced side of the above-mentioned balun 4 are connected to, e.g., a liquid crystal TV (television receiver) 16 via a coaxial cable 14. The above-mentioned balun 4 used in the present embodiment is one that performs mode conversion and impedance conversion of a 200Ω balanced input into a 75Ω unbalanced output.

Note that the connection between the above-mentioned coaxial cable 14 and the above-mentioned liquid-crystal TV 16 is made using a pin-jack connector having a pin arrangement shown in FIG. 2A.

The above-mentioned coaxial cable 14 is, as shown in FIG. 2B, an integrated coaxial cable in which signal lines for high-frequency signals and signal lines for audio signals are integrated with each other, and it performs transmission of high-frequency signals and transmission of left and right audio signals through the single coaxial cable. It is not necessarily essential to transmit the signal lines for high-frequency signals and the signal lines for audio signals through a single coaxial cable. Although it may be acceptable to transmit the signals through different cables, it would be preferable to transmit high-frequency signals and audio signals through a single coaxial cable because the number of cables used is small and a downsized, weight-reduced, and inexpensive cable can be implemented.

The above-mentioned coaxial cable 14 connects between the present earphone antenna 2 and a receiving circuit (receiving apparatus) 19 of a wireless device, e.g., the liquid-crystal TV (television receiver) 16, and has a structure such as that shown in FIG. 2B.

That is, the present coaxial cable 14 is formed by using, as a cable conductor, a central conductor 31 that passes high-frequency signals therethrough, and by sheathing the central conductor 31 with an insulator 32, sheathing the above-mentioned insulator 32 with a shielding wire (e.g., formed from a bare annealed copper wire) 33, sheathing the above-mentioned shielding wire 33 by winding the outer side thereof with, e.g., a tape 34, winding three audio signal lines 35*a*, 35*b*, 35*c* isolated from each other on the outer side of the tape 34, and covering the outer side thereof with an insulating jacket 36. One of the above-mentioned three audio signal lines 35*a*, 35*b*, 35*c* is a left-side audio signal line, another one is a right-side audio signal line, and the third is a common audio signal line (ground line). However, in the present embodiment, it is configured to transmit audio signals through the left and right audio signal lines and the shielding wire, while leaving the common audio signal line idle.

The above-mentioned left and right loading boxes 10L, 10R are inserted between the audio/high-frequency dual-function signal lines 8La, 8Lb, 8Ra, 8Rb and the left and right earphone units 12L, 12R, respectively.

And, the above-mentioned loading box 10L has loading coils LLa, LLb arranged such as shown in FIG. 2C, and it has ferrite beads F1La, F1Lb, as high-frequency cutting means, which are connected at one end thereof to the above-mentioned loading coils LLa, LLb, and at the other end of the ferrite beads F1La, F1Lb to the left earphone unit 12L.

Further, the loading box 10R has loading coils LRa, LRb, and ferrite beads F1Ra, F1Rb, as high-frequency cutting means, which are connected at one end thereof to the above-mentioned loading coils LRa, LRb, and at the other end of the ferrite beads F1Ra, F1Rb to the right earphone unit 12R.

These ferrite beads (e.g., BLM18HD102SN1 (1608 SIZE) manufactured by Murata Manufacturing Co., Ltd.) F1Ra, F1Rb present low impedance for audio signals ranging from 50 to 20,000 Hz, permitting transmission of audio signals between the loading coils LLa, LLb, LRa, LRb and the earphone units 12L, 12R. Further, they present high impedance for high-frequency signals to cut the signals therebetween. Therefore, they can prevent the compromising of the stability of reception due to a high-frequency signal entering from the human body to the receiving apparatus 19 side via the earphone units 12L, 12R and the audio/high-frequency dual-function signal lines 8La, 8Lb, 8Ra, 8Rb, and the like.

Reference symbols C2L and C2R denote band-expanding capacitors connected between terminals of the earphone units 12L and 12R, respectively, each of which has a capacitance of, e.g., 10 pF.

Figure 3:
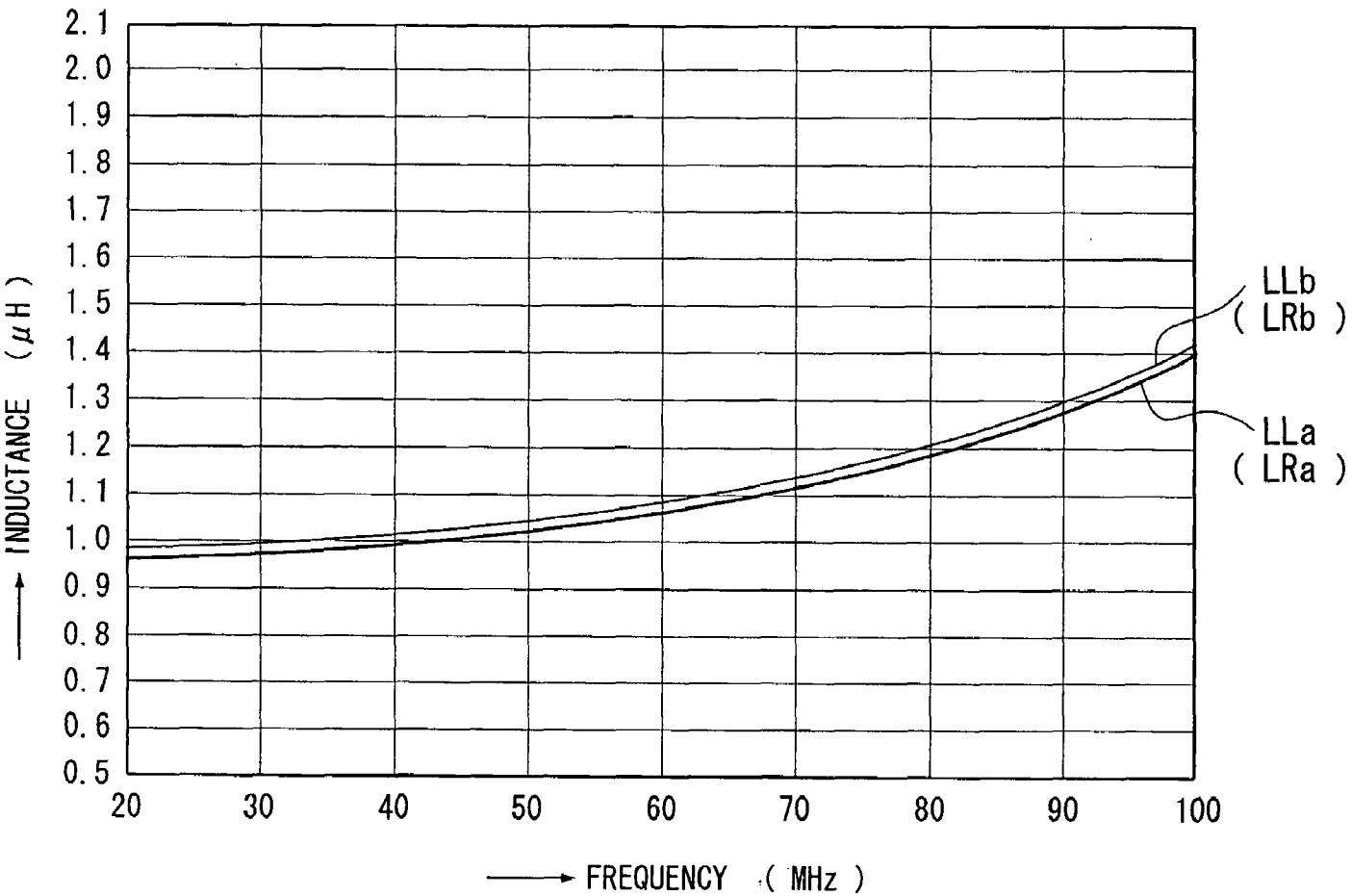
FIG. 3 is a curve showing a relationship between frequency and inductance of loading coils used in the above-mentioned embodiment.
Figure 4:
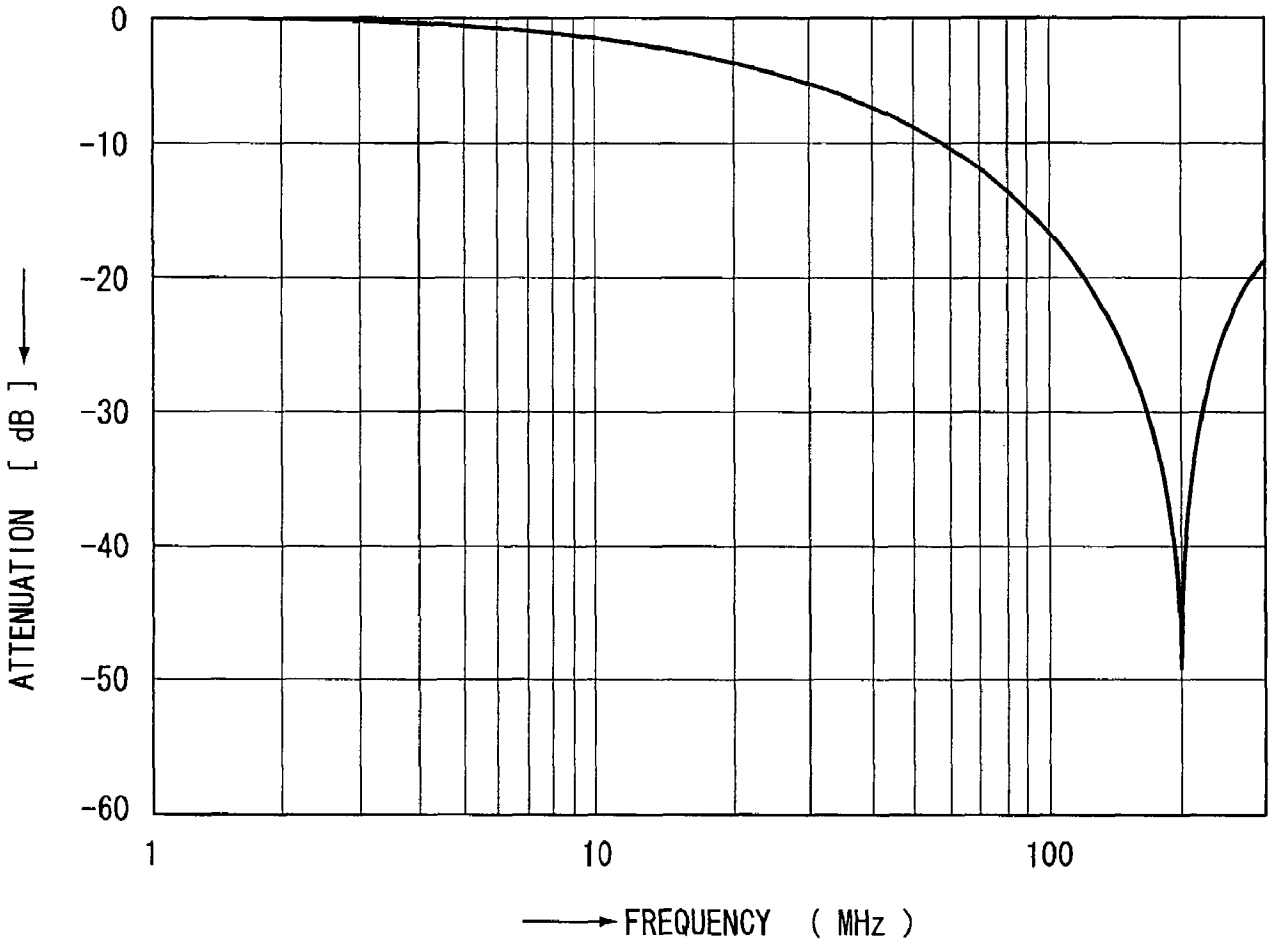
FIG. 4 is a curve showing a relationship between frequency and insertion loss of the loading coils used in the above-mentioned first embodiment.

By the way, in the above-mentioned loading coils LLa, LLb, LRa, LRb, their inductance has a frequency dependency such as that shown in FIG. 3, with their inductance being, e.g., approximately 1.4 μH at 100 MHz. And, as shown in FIG. 4, their insertion loss is designed to maximize at 200 MHz. Specifically, their insertion loss reaches as high as 50 dB at 200 MHz. Therefore, they present so high impedance as to substantially produce electric isolation. Incidentally, their insertion loss is only as low as 15 dB at 100 MHz, and their impedance is so low as not to produce electric isolation.

Note that the above-mentioned loading boxes 10L, 10R are joined together by an insulating neck strap 20 to form a loop into which the head is inserted, to play the role of allowing the earphone antenna 2 to be hung around the neck. However, they play no particular role in terms of high frequency. Therefore, in FIG. 1B, which is a circuit diagram, the neck strap 20 is shown by a two-dot chain line.

Reference symbols 18L, 18R denote audio signal transmission lines, which are connected to the audio/high-frequency dual-function signal lines 8La, 8Ra via ferrite beads F2LA, F2RA (e.g., BLM18HD102SN1 (1608 SIZE) manufactured by Murata Manufacturing Co., Ltd.). And, the audio/high-frequency dual-function signal lines 8Rb, 8Rb are grounded via ferrite beads F2LC, F2RC having the same property as that of the above-mentioned ferrite beads F2LA, F2RA.

These ferrite beads F2LA, F2RA, F2LC, F2RC serve to prevent leakage of high-frequency signals into the audio signal paths. In a high frequency band of television broadcasting signals, they present high impedance (e.g., 1 kΩ or higher) to cut the high-frequency signals, while in a frequency band (20 kHz or lower) of audio signals, they present low impedance to permit passage of the audio signals.

Reference symbols C1L, C1R denote capacitors (a capacitance of, e.g., 10 pF) inserted between the audio/high-frequency dual-function signal lines 8La, 8Ra and the balanced terminals of the balun 4, respectively, which are for isolation of the audio/high-frequency dual-function signal lines 8La, 8Ra from the audio/high-frequency dual-function signal lines 8Lb, 8Rb, respectively.

Reference symbols C3L, C3R denote band-expanding capacitors inserted between the audio/high-frequency dual-function signal lines 8La, 8Lb, and between the audio/high-frequency dual-function signal lines 8Ra, 8Rb, which are for expansion of the receiving frequency band of the antenna. However, isolation is achieved between the signal lines in the frequency band of audio signals.

In this earphone antenna 2, a 100-MHz resonant V-shaped dipole antenna, a 200-MHz resonant V-shaped dipole antenna, and the audio signal lines coexist. That is, the antenna 2 has a function as the 100-MHz resonant V-shaped dipole antenna, a function as the 200-MHz resonant U-shaped dipole antenna, and a function of transmitting the left and right audio signals to the left and right earphone units 12L, 12R.

First, the function as the 100-MHz resonant V-shaped dipole antenna will be described.

As shown in FIG. 4, the loading coils LLa, LLb, LRa, LRb have a low insertion loss that is in the order of 10 dB (gain=−10 dB) for 100-MHz signals, and thus they cannot isolate between the loading coils LLa, LLb, LRa, LRb and the conductor lines 8La, 8Lb, 8Ra, 8Rb in terms of high frequency.

Therefore, for 100-MHz signals, a V-shaped dipole antenna formed from the audio/high-frequency dual-function signal lines 8La, 8Lb, 8Ra, 8Rb and the loading coils LLa, LLb, LRa, LRb functions as a receiving antenna for resonance.

And, the loading coils LLa, LLb, LRa, LRb have a resonant antenna length reducing function that reduces the antenna length required for resonance at a fundamental frequency (e.g., 100 MHz), to play the role of enhancing the receiving sensitivity for low-frequency signals even with the short antenna length.

That is, a dipole antenna typically requires an antenna length of as long as 0.753 meters on one side thereof for resonance at 100 MHz. This is unpractical for a portable wireless device (liquid crystal TV).

However, the present earphone antenna 2 includes the loading coils LLa, LLb, LRa, LRb, and the above-mentioned resonant antenna length reducing function mentioned above permits reception of low-frequency signals at a sufficient sensitivity even with its short antenna length.

Specifically, the inductances of the loading coils LLa, LLb each are approximately 1.4 μH at 100 MHz, and this makes it possible to produce resonance with a practical antenna length suitable for hanging around the neck for signals belonging to a low frequency band (having relatively long wavelengths) within a frequency band of 100 MHz usable for television broadcasting.

Therefore, a 100-MHz resonant dipole antenna is formed with a practical antenna length, and thus resonance occurs at 100 MHz, and resonance occurs further with its harmonics (a third harmonic, a fifth harmonic, a seventh harmonic).

Next, the function as the 200-MHz resonant dipole antenna will be described.

As shown in FIG. 4, the above-mentioned loading coils LLa, LLb, LRa, LRb exhibit an insertion loss of as high as 50 dB (gain: −50 dB) for signals having a frequency of 200 MHz, substantially isolating themselves from the audio/high-frequency dual-function signal lines 8La, 8Lb, 8Ra, 8Rb, to cause only the audio/high-frequency dual-function signal lines 8La, 8Lb, 8Ra, 8Rb to function as an antenna.

And, a dipole antenna formed from only the audio/high-frequency dual-function signal lines 8La, 8Lb, 8Ra, 8Rb has an antenna length of 37 cm on one side thereof, and thus it resonates with signals having the frequency of 200-MHz. Consequently, a 200-MHz resonant V-shaped dipole antenna exists which resonates with signals having the frequency of 200-MHz and excites with harmonics of 200 MHz (a third harmonic, a fifth harmonic, a seventh harmonic).

Note that in the case of a dipole antenna, a tendency exists that the actual resonant wavelengths to the respective antenna lengths are somewhat shorter than their calculated values.

Next, the function of transmitting audio signals will be described.

Left and right audio signals transmitted via the cable 14 from the receiving apparatus 19 of the wireless device body 16 are transmitted to the audio/high-frequency dual-function signal lines 8La, 8Lb, 8Ra, 8Rb via the left and right signal lines 18L, 18R and an earth line, and they are further transmitted to the earphone units 12L, 12R via the loading boxes 10L, 10R, for reproduction of sounds at the above-mentioned earphone units 12L, 12R.

At that time, leakage of the audio signals can be blocked by the audio signal cutting capacitors C1L, C2R.

In this way, having also the function of transmitting audio signals, the present earphone antenna 2 can integrate the antenna with the earphones.

In this way, the present earphone antenna 2 functions both as a 100-MHz resonant dipole antenna and a 200-MHz resonant dipole antenna, without any sensitivity adjusting operation, and thus it can obtain a sufficiently high receiving sensitivity over a wide range that sufficiently covers the frequency band usable for television broadcasting through its resonance at 100 MHz and 200 MHz and its excitation with harmonics of 100 MHz and 200 MHz (a third harmonic, a fifth harmonic, a seventh harmonic). Further, it can also transmit the left and right audio signals from the receiving apparatus 19 of the wireless device body 16 to the earphone units 12L, 12R.

And, the ferrite beads F1La, F1Lb, F1Ra, F1Rb can prevent a high frequency-derived negative influence from being exerted upon the earphone antenna 2 from the human body through the earphone units 12L, 12R, and they can prevent compromising the stability of reception on the side of the wireless device body 16 due to the human body.

Further, the loading coils LLa, LLb, LRa, LRb can even be eliminated, at the cost of some compromising receiving sensitivity. In this case, the band-expanding capacitors C3L, C3R are eliminated, and the audio/high-frequency dual-function signal lines 8La, 8Lb, and 8Ra, 8Rb are connected directly to the ferrite beads F1La, F1Lb, and F1Ra, F1Rb, respectively. At this time, by setting the signal line lengths of the audio/high-frequency dual-function signal lines 8La, 8Lb, and 8Ra, 8Rb to 37 cm, an antenna can be implemented which resonates at 200 MHz with λ/4, and at 100 MHz with λ/8, and resonates with harmonics (a third harmonic, a fifth harmonic, a seventh harmonic) in the UHF band (470 MHz to 770 MHz). Using this modified example, an advantage is provided that the number of components is smaller, although at the cost of some lower sensitivity, than in Embodiment 1.

Figure 5B:
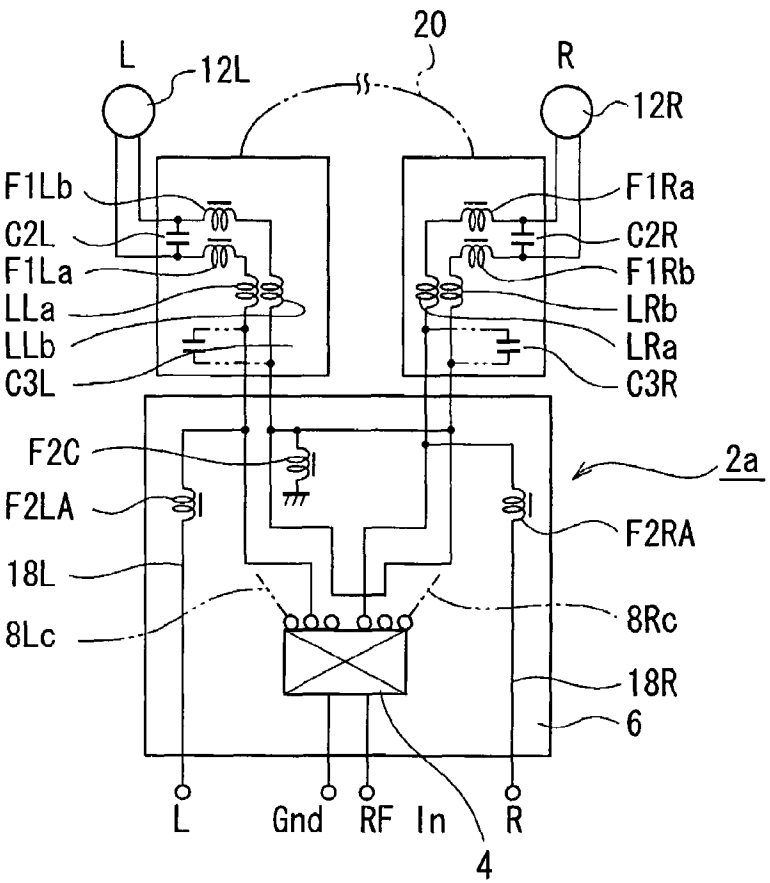
Figure 5A:
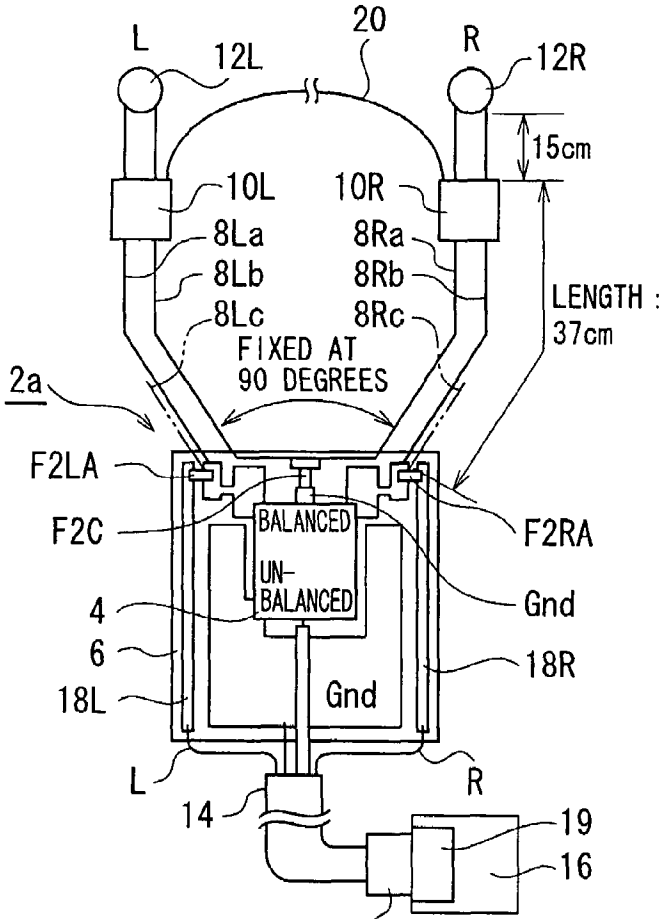

FIGS. 5A, 5B show a second embodiment 2a of an earphone antenna of the present invention, in which FIG. 5A is a configurational diagram, and FIG. 5B is a circuit diagram of the antenna.

The present embodiment 2a is configured such that the audio/high-frequency dual-function signal lines 8Lb and 8Rb are connected to each other, and they are not connected to the terminals on the balanced side of the balun 4 to have a modified folded dipole antenna configuration. And, a ferrite bead FBC is connected between the audio/high-frequency dual-function signal lines 8Lb, 8Rb and a ground. Further, the audio signal isolating capacitors C1L, C1R are eliminated, and the terminals on the balun side of the audio/high-frequency dual-function signal lines 8Lb, 8Rb and the terminals which are on the balun side of the audio/high-frequency dual-function signal lines 8Lb, 8Rb and to which the capacitors C1L, C1R were connected are integrated with each other. The present embodiment 2a differs from the first embodiment 2 at these three points, but it is the same save these points.

According to the present embodiment 2a, since it has a modified folded dipole antenna configuration, its impedance is four times that of a typical dipole antenna configuration. Therefore, there is an advantage that impedance matching at the balun 4 is made easier. Further, it has another advantage that the band is wider than with the dipole antenna.

Figure 6B:
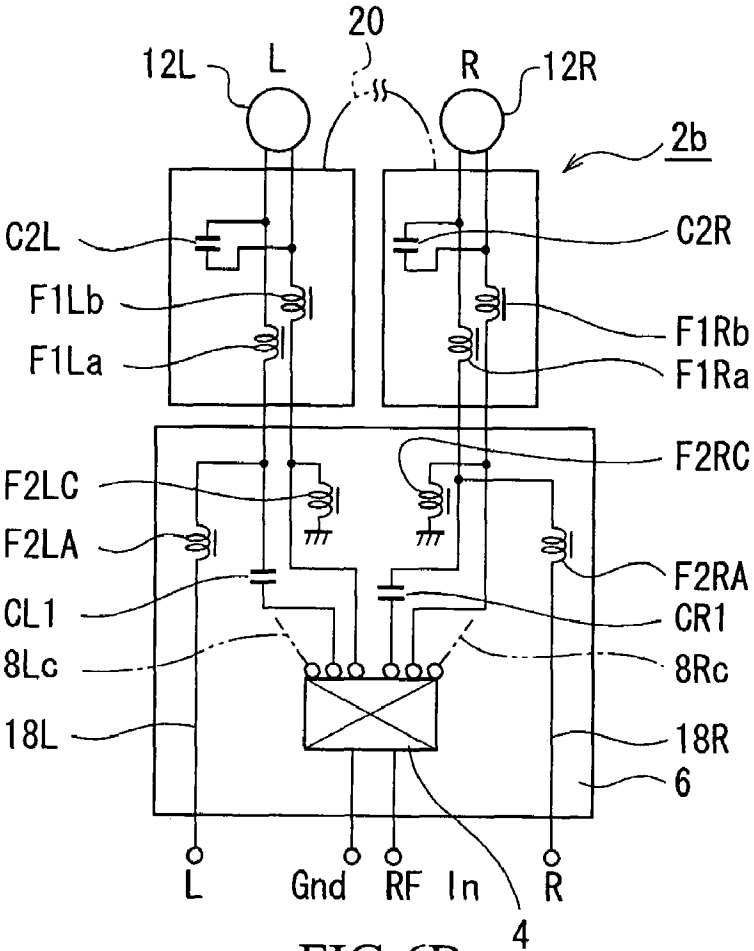
Figure 6A:
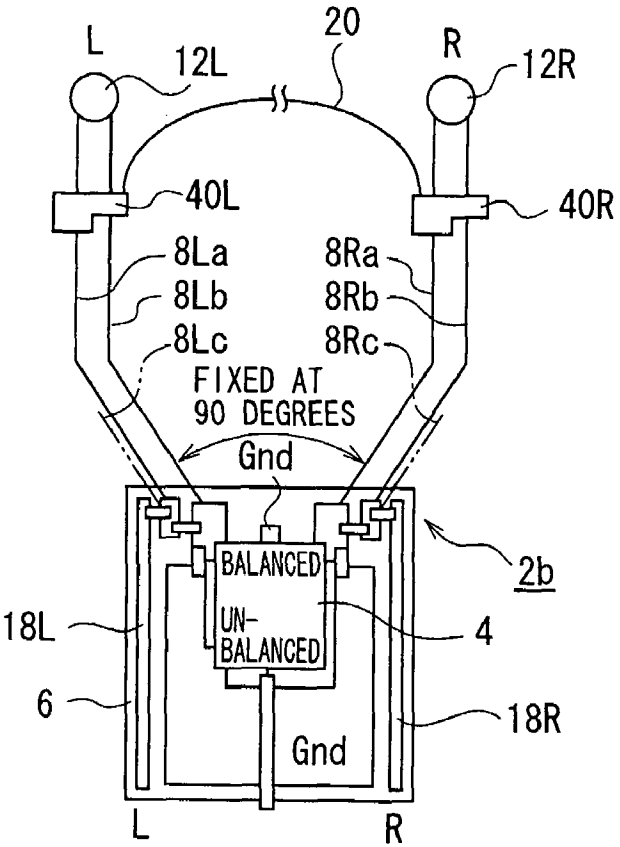

FIGS. 6A and 6B show a third embodiment 2b of an earphone antenna of the present invention, in which FIG. 6A is a configurational diagram, and FIG. 6B is a circuit diagram of an antenna.

The present embodiment 2b is an embodiment in which the present invention is applied to an antenna that receives digital terrestrial waves, and thus it suffices that the antenna can receive the UHF (470-770 MHz) frequencies.

Therefore, there is no need to provide loading coils as in the first and second embodiments 2, 2a. Additionally, shorter audio/high-frequency dual-function signal lines 8La, 8Lb, 8Ra, 8Rb would do.

In the present embodiment 2b, the length of each of the audio/high-frequency dual-function signal lines 8La, 8Lb, 8Ra, 8Rb is set to 15 cm, and in addition thereto, wires 8Lc, 8Rc, which are 11 cm long each, extend from lands on the balun side of the lines 8La, 8Ra. These wires 8Lc, 8Rc are 5 mm or more spaced apart from each other, and so are the lines 8Lb, 8Rb. The audio/high-frequency dual-function signal lines 8La, 8Lb, and 8Ra, 8Rb extend from the balun 4 so as to form an angle of, e.g., 90°, and that angle is fixed.

And, as mentioned above, no loading coils are required, and thus ferrite beads F1La, F1Lb, F1Ra, F2Rb are connected at one end thereof to terminals on the non-balun side of the audio/high-frequency dual-function signal lines 8La, 8Lb, 8Ra, 8Rb and at the other end of the above-mentioned ferrite beads F1La, F1Lb, F1Ra, F1Rb to the earphone units 12L, 12R. Reference symbols C2L, C2R denote band-expanding capacitors. These ferrite beads F1La, F1Lb, F1Ra, F1Rb and the band-expanding capacitors C2L, C2R are accommodated within ferrite bead/capacitor boxes 40L, 40R, respectively, and the neck strap 20 is joined between the above-mentioned boxes 40L, 40R so that the antenna can be hung around the neck.

According to the present embodiment 2b, high-frequency signals over the entire UHF frequency band (470-770 MHz) usable for digital terrestrial waves can be received.

Note that the audio/high-frequency dual-function signal lines 8La, 8Lb, and 8Ra, 8Rb extend so as to form an angle of, e.g., 90° from the balun 4 to implement a V-shaped dipole antenna configuration in each of the above-mentioned embodiments. However, alternatively, the present invention may be embodied in such a mode as to set the angle to approximately 180° to implement an U-shaped dipole antenna configuration.

INDUSTRIAL APPLICABILITY

According to the earphone antenna as claimed in claim 1, the balun performs impedance conversion from the balanced mode into the unbalanced mode, and further, the above-mentioned two pairs of audio/high-frequency dual-function signal lines are caused to function as a receiving antenna for high-frequency signals and as audio signal transmission means for audio signals. As a result, integration of the high-frequency receiving antenna with the earphones can be implemented.

According to the earphone antenna as claimed in claim 2, high-frequency signal cutting means are provided between the earphones and the audio/high-frequency dual-function signal lines, the high-frequency signal cutting means presenting high impedance for high-frequency signals to substantially cut the high-frequency signals and low impedance for audio signals to permit transmission of the signals. As a result, exertion of a high frequency-derived negative influence upon a receiving apparatus of a wireless device from the human body via earphones can be blocked by the high-frequency signal cutting means.

According to the wireless device as claimed in claim 3, since the earphone antenna as claimed in claim 1 is used, the advantages provided by the earphone antenna can be enjoyed.

According to the earphone antenna as claimed in claim 4, a high-frequency signal can be mode-converted from the balanced mode into the unbalanced mode at the balun, and also the loading coils present a high impedance for signals having a specific frequency (e.g., 200 MHz) higher than a fundamental frequency (e.g., 100 MHz) for isolation from the above-mentioned two pairs of audio/high-frequency dual-function signal lines, thereby causing the above-mentioned audio/high-frequency dual-function signal lines to function as a dipole antenna for resonance.

Further, the above-mentioned loading coils present a low impedance for signals having the fundamental frequency (e.g., 100 MHz) to cause the above-mentioned two pairs of audio/high-frequency dual-function signal lines and the respective loading connected thereto to function as a dipole antenna for resonance.

Hence, a dipole antenna that resonates at the fundamental frequency (e.g., 100 MHz) and further resonates with its harmonics (a third harmonic at, e.g., 300 MHz, a fifth harmonic at, e.g., 500 MHz, and a seventh harmonic at, e.g., 700 MHz) and a dipole antenna that resonates with signals having a specific frequency (e.g., 200 MHz) higher than a preset frequency (e.g., 100 MHz) and excites with its harmonics (a third harmonic at, e.g., 600 MHz, and the like) are formed from the above-mentioned two pairs of audio/high-frequency dual-function signal lines, whereby a sensitivity characteristic that exhibits relatively small variations in receiving sensitivity can be obtained over a wide frequency band, and thus no sensitivity adjustment of the earphone antenna is required at all in order to obtain the sensitivity characteristic.

Note that the loading coils shorten an antenna length required for resonance at the fundamental frequency (e.g., 100 MHz), to allow resonance to occur with signals having long wavelengths even with a short antenna length. As a result, the receiving sensitivity to low-frequency signals can be enhanced without unreasonably increasing the antenna length. This is an advantage that is not negligible.

Therefore, a sensitivity characteristic that exhibits relatively small variations in receiving sensitivity can be obtained over a wide frequency band, and thus no sensitivity adjustment of the earphone antenna is required at all in order to obtain the sensitivity characteristic.

Further, according to the earphone antenna as claimed in claim 4, the above-mentioned respective pairs of audio/high-frequency dual-function signal lines and the above-mentioned loading coils are configured to function as audio signal transmission means for audio signals of the above-mentioned left and right earphone units. As a result, integration of the earphone units with the antenna can be implemented.

Therefore, the antenna can be used for the reception of high-frequency signals over a wide frequency band and also as a means for transmitting audio signals to the earphone units, whereby integration of the high-sensitivity, wide-band antenna with the earphones becomes possible.

According to the earphone antenna as claimed in claim 5, it is configured to form a folded dipole antenna. Thus, its impedance becomes four times that of a typical dipole antenna configuration. Therefore, there is an advantage that impedance matching at the balun is made easier.

According to the earphone antenna as claimed in claim 6, one and the other of the two pairs of audio/high-frequency dual-function signal lines form an angle of approximately 180°, the one and the other of the two pairs being in portions of the two pairs which are on a side connected to the terminals on the balanced-mode side of the balun. Thus, the two pairs of audio/high-frequency dual-function signal lines function as a U-shaped dipole antenna for the high-frequency signals having the above-mentioned specific frequency.

According to the earphone antenna as claimed in claim 7, one and the other of the two pairs of audio/high-frequency dual-function signal lines form an angle smaller than 180°, the one and the other of the two pairs being in portions of the two pairs which are on a side connected to the terminals on the balanced-mode side of the balun. Thus, the two pairs of audio/high-frequency dual-function signal lines function as a V-shaped dipole antenna for the high-frequency signals having the above-mentioned specific frequency.

According to the earphone antenna as claimed in claim 8, a high-frequency cutting means is provided between the audio/high-frequency dual-function signal lines and each of the earphone units, the high-frequency cutting means presenting a high impedance for high-frequency signals for isolation therebetween in terms of high frequency and presenting a low impedance for audio signals to permit transmission of the audio signals. As a result, exertion of high frequency-derived negative influence upon the receiving apparatus of the wireless device from the human body via the earphones can be blocked by the high-frequency signal cutting means.

According to the earphone antenna as claimed in claim 9, a band-expanding capacitor is connected between audio/high-frequency dual-function signal lines in each of the left and right pairs, and thus the frequency characteristics in receiving sensitivity as an antenna can be expanded toward the lower frequency side.

According to the earphone antenna as claimed in claim 10, a high-frequency cutting means presenting a high impedance for high-frequency signals is inserted into a audio signal line for transmitting a audio signal to the audio/high-frequency dual-function signal lines, and thus leakage of received high-frequency signals from the audio/high-frequency dual-function signal lines to the audio signal lines can be prevented.

According to the composite coil as claimed in claim 11, a plurality of conductor lines are wound around a single core to form a plurality of coils, each of the coils having the same number of turns and the same impedance. Thus, a plurality of coils can be formed by occupying an area and a volume substantially as small as one coil, and consequently, devices and the like using a plurality of coils can be downsized and weight-reduced.

According to the earphone antenna as claimed in claim 12, the above-mentioned composite coil is used as each of the left and right pairs of loading coils, and thus the size of four loading coils can be reduced to that for two coils.

According to the earphone antenna as claimed in claim 13, portions each provided with the above-mentioned pair of loading coils are joined together via a neck strap, and thus the earphone antenna can be configured for hanging around the neck.

According to a wireless device as claimed in claim 14, the above-mentioned earphone antenna is used, and thus the advantages provided by the above-mentioned earphone antenna can be enjoyed.

According to the coaxial cable as claimed in claim 15, both high-frequency signals and the pair of left and right audio signal lines can be transmitted by a single cable. Thus, in order to transmit high-frequency signals and audio signals, there is no need any longer to provide a plurality of cables, i.e., a cable for transmitting the high-frequency signal and a cable for transmitting a pair of left and right audio signals.

According to the wireless device as claimed in claim 16, the coaxial cable is used for a connection between the balun and the receiving apparatus. Thus, in order to transmit high-frequency signals and audio signals between the receiving apparatus and the earphones, there is no need any longer to provide a plurality of cables, i.e., a cable for transmitting the high-frequency signal and a cable for transmitting the pair of left and right audio signals. Consequently, only one coaxial cable is needed.

The invention claimed is:

1. An earphone antenna having a balun for converting a balanced mode into an unbalanced mode, and a pair of audio/high-frequency dual-function signal lines for connection to a left earphone unit and a pair of audio/high-frequency dual-function signal lines for connection to a right earphone unit, connected to terminals on a balanced-mode side of said balun, said earphone antenna characterized by being configured such that:

said two pairs of audio/high-frequency dual-function signal lines function as a receiving antenna for high-frequency signals, and said two pairs of audio/high-frequency dual-function signal lines function as audio signal transmission means to said left and right earphone units for audio signals.

2. The earphone antenna according to claim 1, characterized by:

a high-frequency signal cutting means provided between said left and right earphone units and said respective audio/high-frequency dual-function signal lines connected thereto, having high impedance against high-frequency signals to substantially cut the high-frequency signals, and low impedance for audio signals to permit transmission of the signals.

3. A wireless device characterized by an earphone antenna having a balun for converting a balanced mode into an unbalanced mode, a pair of audio/high-frequency dual-function signal lines for connection to a left earphone unit and a pair of audio/high-frequency dual-function signal lines for connection to a right earphone unit, connected to terminals on a balanced-mode side of said balun, and configured such that said two pairs of audio/high-frequency dual-function signal lines function as a receiving antenna for high-frequency signals, and said two pairs of audio/high-frequency dual-function signal lines function as audio signal transmission means to said left and right earphone units for audio signals; and a receiving apparatus connected to a terminal on an unbalanced side of said balun of said earphone antenna via a cable.

4. A wireless device according to claim 3, characterized by:

using a coaxial cable for connection between said balun and said receiving apparatus, wherein said coaxial cable has a central conductor for passing high-frequency signals therethrough, a first insulator for enclosing said central conductor, a shielding wire for enclosing said first insulator, a second insulator for enclosing said shielding wire, and a pair of audio signal lines, wound around an outer side of said second insulator, for transmitting left and right audio signals therethrough, and using said central conductor and said shielding wire of said coaxial cable for transmission of the high-frequency signal, and said respective audio signal lines for transmission of the audio signals.

5. An earphone antenna having a balun for converting a balanced mode into an unbalanced mode, a pair of audio/high-frequency dual-function signal lines corresponding to said left earphone unit and a pair of audio/high-frequency dual-function signal lines corresponding to a right earphone unit, connected to terminals on a balanced-mode side of said balun, and terminals on a non-balun side of each of said pairs of audio/high-frequency dual-function signal lines connected to a corresponding one of said earphone units via respective loading coils;

wherein said respective loading coils are configured to have high impedance for signals having a specific frequency higher than a pre-set fundamental frequency for isolation from said two pairs of audio/high-frequency dual-function signal lines in terms of high frequency to cause said signal lines to function as a dipole antenna, and have low impedance for signals having said fundamental frequency to combine said respective loading coils with said two pairs of audio/high-frequency dual-function signal lines in terms of high frequency by connection to cause a dipole antenna formed from both to function; and further, said respective pairs of audio/high-frequency dual-function signal lines are configured to function as audio signal transmission means for audio signals to said left and right earphone units.

6. The earphone antenna according to claim 5, characterized by being configured to:

connect only one among the pair of audio/high-frequency dual-function signal lines for connection to said left and right earphone units, to a terminal on the balanced side of said balun;

connect together the others of said pair of audio/high-frequency dual-function signal lines in terms of high frequency; and to form a folded dipole antenna from said one and other of the pair of audio/high-frequency dual-function signal lines corresponding to said left earphone unit, and said one and other of the pair of audio/high-frequency dual-function signal lines corresponding to said right earphone unit.

7. The earphone antenna according to claim 1, 2, 5, or 6, characterized in that:

one and other of said two pairs of audio/high-frequency dual-function signal lines form an angle of approximately 180°, wherein said one and other of said two pairs are in portions of said two pairs which are on a side connected to the terminals on the balanced-mode side of said balun, and said two pairs of audio/high-frequency dual-function signal lines function as a U-shaped dipole antenna for the signals having said specific frequency.

8. The earphone antenna according to claim 1, 2, 5, or 6, characterized in that:

one and other of said two pairs of audio/high-frequency dual-function signal lines form an angle smaller than 180°, wherein said one and other of said two pairs are in portions of said two pairs which are on a side connected to the terminals on the balanced-mode side of said balun, and said two pairs of audio/high-frequency dual-function signal lines function as a V-shaped dipole antenna for the signals having said specific frequency.

9. The earphone antenna according to claim 8, characterized in that:

a high-frequency cutting means is provided between said pair of audio/high-frequency dual-function signal lines corresponding to each of said pair of left and right loading coils, and each of said earphone units, wherein said high-frequency cutting means has high impedance for high-frequency signals to isolate therebetween in terms of high frequency, and has low impedance for audio signals to permit transmission of the audio signals.

10. The earphone antenna according to claim 5 or 6, characterized in that:

a high-frequency cutting means is provided between said pair of audio/high-frequency dual-function signal lines corresponding to each of said pair of left and right loading coils, and each of said earphone units, wherein said high-frequency cutting means has high impedance for high-frequency signals to isolate therebetween in terms of high frequency, and has low impedance for audio signals to permit transmission of the audio signals.

11. The earphone antenna according to claim 10 characterized by connecting:

a band-expanding capacitor between audio/high-frequency dual-function signal lines in each of said left and right pairs.

12. The earphone antenna according to claim 1, 2, 5 or 6, characterized by connecting:

a band-expanding capacitor between audio/high-frequency dual-function signal lines in each of said left and right pairs.

13. The earphone antenna according to claim 12, characterized by having:

an audio signal transmission path for transmitting a audio signal to said audio/high-frequency dual-function signal lines of said dipole antenna; and inserting a high-frequency cutting means having high impedance for high-frequency signals, into said audio signal transmission path.

14. The earphone antenna according to claim 1, 2, 5 or 6, characterized by having:

an audio signal transmission path for transmitting a audio signal to said audio/high-frequency dual-function signal lines of said dipole antenna; and inserting a high-frequency cutting means having high impedance for high-frequency signals, into said audio signal transmission path.

15. The earphone antenna according to claim 14, characterized by two composite coils, each having a plurality of coils formed on a single core and having a same number of turns and same impedance, and using each of said coils constituting said composite coils as respective loading coils of each of said left and right pairs.

16. The earphone antenna according to claim 5 or 6, characterized by two composite coils, each having a plurality of coils formed on a single core and having a same number of turns and same impedance, and using each of said coils constituting said composite coils as respective loading coils of each of said left and right pairs.

17. The earphone antenna according to claim 16, characterized by joining a neck strap between portions each provided with said pair of loading coils.

18. The earphone antenna according to claim 1, 2, 5 or 6, characterized by joining a neck strap between portions each provided with said pair of loading coils.

19. A wireless device characterized by:

said earphone antenna according to claim 18, and a receiving apparatus connected to a terminal on an unbalanced-mode side of said balun.

20. A wireless device characterized by:

said earphone antenna according to claims 5 or 6; and a receiving apparatus connected to a terminal on an unbalanced-mode side of said balun.

21. A wireless device according to claim 20, characterized by:

using a coaxial cable for connection between said balun and said receiving apparatus, wherein said coaxial cable has a central conductor for passing high-frequency signals therethrough, a first insulator for enclosing said central conductor, a shielding wire for enclosing said first insulator, a second insulator for enclosing said shielding wire, and a pair of audio signal lines, wound around an outer side of said second insulator, for transmitting left and right audio signals therethrough, and using said central conductor and said shielding wire of said coaxial cable for transmission of the high-frequency signal, and said respective audio signal lines for transmission of the audio signals.

* * * * *